United States Patent [19]

Benz et al.

[11] Patent Number: 4,785,855

[45] Date of Patent: Nov. 22, 1988

[54] WEFT YARN STORE FOR LOOMS HAVING A BRAKING DEVICE

[75] Inventors: Rolf Benz, Cachnang, Switzerland; John D. Griffith, Ru, England

[73] Assignee: Sulzer Brothers Limited, Winterthur, Switzerland

[21] Appl. No.: 47,127

[22] Filed: May 8, 1987

[30] Foreign Application Priority Data

May 15, 1986 [CH] Switzerland ..... 01977/86

[51] Int. Cl.[4] ..... D03D 47/36

[52] U.S. Cl. ..... 139/452; 242/47.01; 242/149

[58] Field of Search ..... 139/429, 452; 242/47.01, 149

[56] References Cited

U.S. PATENT DOCUMENTS

| | | | |
|---|---|---|---|
| 4,079,759 | 3/1978 | Riha et al. . | |
| 4,261,526 | 4/1981 | Roj | 139/452 |
| 4,541,462 | 9/1985 | Tholander | 139/452 |
| 4,574,847 | 3/1986 | Matsumoto | 139/452 |

FOREIGN PATENT DOCUMENTS

| | | | |
|---|---|---|---|
| 0049897A1 | 4/1982 | European Pat. Off. . | |
| 1535643 | 11/1970 | Fed. Rep. of Germany . | |
| 2253259 | 4/1974 | Fed. Rep. of Germany . | |
| 2555802A1 | 6/1977 | Fed. Rep. of Germany . | |
| 3600066 | 11/1986 | Fed. Rep. of Germany . | |
| 971763 | 11/1982 | U.S.S.R. | 139/452 |

*Primary Examiner*—Henry S. Jaudon

*Attorney, Agent, or Firm*—Burns, Doane, Swecker & Mathis

[57] ABSTRACT

A weft yarn store for looms has a stationary drum (10) for storing a weft yarn supply (23) and a braking device (13) at the end of the drum. A resiliently deformable brake element (132) is movable by means of an adjusting device (131) relatively to a braking surface of the drum. The adjusting device may be an annular electromagnet 131 and is in direct operative engagement with low-inertia parts of the brake element 132. Such parts can be finger-like lamellae disposed one beside another on the outer drum periphery (10). The action of the braking device can therefore be accurately adjusted to the departing weft yarn so that the same is retarded gently at the end of picking into a loom.

7 Claims, 3 Drawing Sheets

WEFT YARN STORE FOR LOOMS HAVING A BRAKING DEVICE

FIELD OF THE INVENTION

The invention relates to a weft yarn store for looms, yarn being supplied to the store from a weft package and being drawn off from the store intermittently for picking into the shed of a loom. In the type of weft yarn store with which the invention is concerned, the yarn is wound onto a drum for storage. A brake device cooperating with the dum is necessary for proper operation of the system. The present invention is concerned particularly with such brake devices and their relationships to the weft storage drums.

BACKGROUND

U.S. Pat. No. 4,079,759 discloses a braking device for a weft yarn store, the device comprising a ring which has a resilient insert and which is movable axially towards the drum of the store. A bent lever acts by way of a cam drive to move the brake disc towards the drum, the kinetic energy of the disc being dissipated when the disc impacts the drum periphery. The resulting shock is reduced by the resilient insert but the clamping of the weft yarn between the drum periphery and the brake disc is abrupt. The resilient insert can compensate for errors of alignment between the drum axis and the brake disc axis; however, in this case different surface pressures arise in the contact zone so that the braking of the weft yarn varies with its position on the drum periphery. Consequently, weft yarn lengths may vary between consecutive picks.

SUMMARY OF THE INVENTION

It is an object of this invention to provide a weft yarn store whose braking device brakes the weft yarn gently with a controllable surface pressure at the braking station, the same reproducible conditions existing in each braking operation in all parts of the brake.

According to the invention, the means for moving the brake element are in direct operative engagement with low-mass brake element parts which engage intimately with the braking surface periphery. The brake element can comprise a number of finger-like lamellae or small thin plates disposed one beside another adjacent the drum outer periphery and pressed thereagainst, for example, by means of a magnetic field. The lamellae can have one end secured either pivotally or rigidly to a ring which extends around the drum and are engaged with the periphery thereof by magnetic forces, it being possible for the weft yarn to be clamped and retarded to a standstill as it runs off between the lamellae and the drum. The lamellae-like braking elements can be incorporated in the drum periphery, in which event they are pressed during braking against the inside of a ring around the drum. The braking element can take the form of a single loop of wire around the drum periphery, the loop being tightened on braking and engaging with the entire periphery of the drum. In cases in which the braking elements contact the drum periphery, they are readily flexible in order to engage such periphery with a uniform force.

The features described enable the action of the braking device to be finely graded so that the weft yarn is retarded gently at the end of picking.

BRIEF DESCRIPTION OF THE DRAWINGS

The invention will be described in detail hereinafter with reference to the drawings wherein.

DETAILED DESCRIPTION OF PREFERRED EMBODIMENTS

Figure 1:
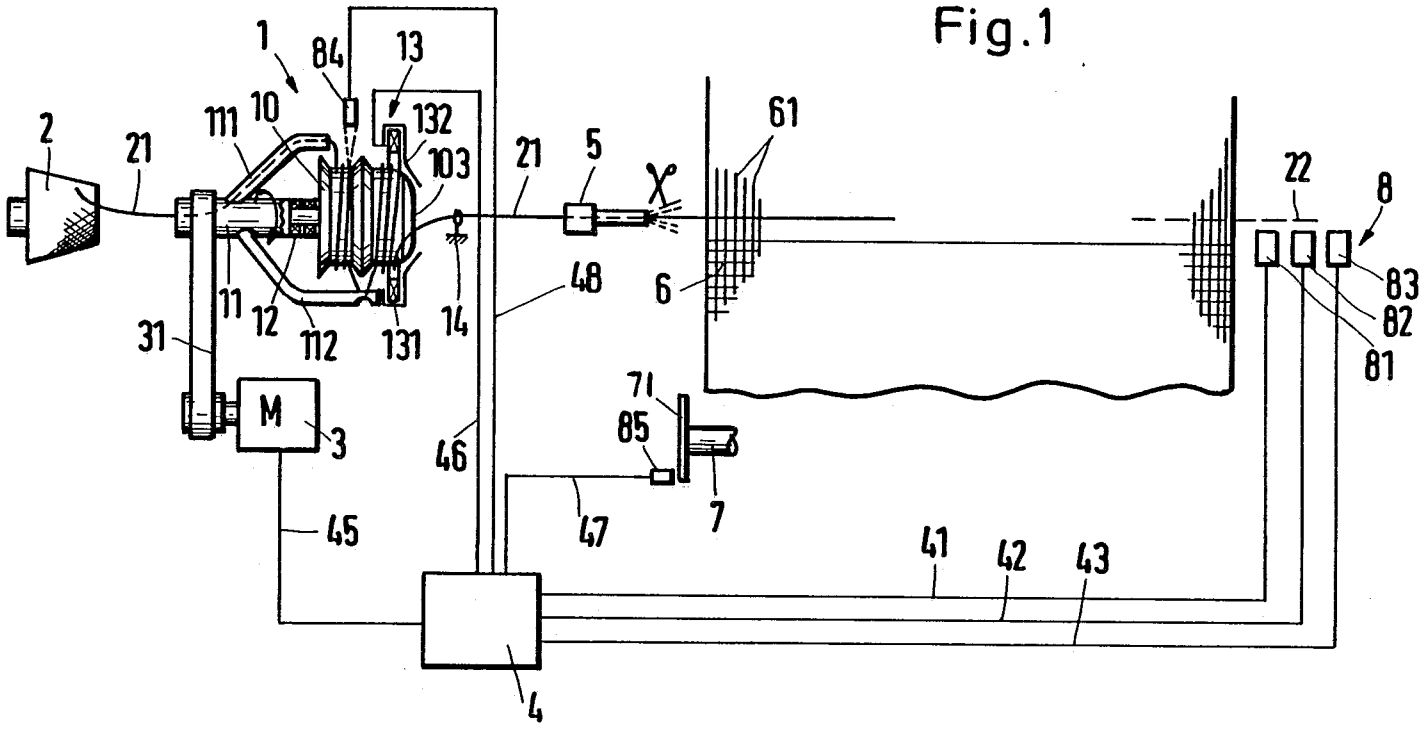
FIG. 1 is a view showing the complete extent of weft yarn movement, including its passage through the weft yarn store, during weaving.

A weft yarn store 1 receives weft yarn 21 from a weft package 2 by way of a bore in winder shaft 11 and winding arm 111. The weft yarn is initially deposited in a number of loops on the left-hand part of drum 10, then wound by a second winding arm 112 on the right-hand part of drum 10 in FIG. 1. A braking device 13 extends around the yarn departure end of the drum 10 by way of a ring magnet 131 and low-mass braking elements 132 disposed on the magnet 131 on the drum periphery and responding to energization of the magnet 131 by their ends near the drum axis engaging with the conical drum periphery on the right, such periphery being operative as a braking surface 103. At the end of picking between warp yarns 61, the yarn 21 is therefore clamped between the surface 103 and the elements 132 and retarded to a standstill. In the embodiment shown the drum is mounted on the winder shaft 11 by way of a mounting 12 and is secured against rotation by a magnetic field or other known techniques which need not be illustrated here.

A controllable driving motor 3 drives the winder shaft 11 by way of a belt 31 and is connected by way of a control line 45 to a control 4. At the start of weaving, the motor speed is adjusted to a value corresponding to the selected loom speed and to the width of the cloth 6. If the yarn length per working cycle of the loom delivered by the arm 111, 112 is equal to the yarn length required per pick, the amount of winding on the drum 10 does not vary from one pick to the next. However, if the winder 111 undershoots the required yarn supply, a yarn supply detector 84 communicates this state by way of a control line 48 to the control 4, and the speed of the shaft 11 is increased.

The length of weft yarn picked by a main nozzle 5 is determined by the period of time between the opening of the braking device 13 and its subsequent closure. The opening and closing times of the device 13 are coordinated with the state of the loom by way of an angle disc 71 on the main shaft of loom 7 and by way of an angle detector 85, control line 47 and the control 4. Release of the device 13 and, therefore, release for picking can be determined for a particular position of the disc 71 relatively to the detector 85, while the instant of closure of the device 13 depends upon how far the weft yarn tip 22 travels into the detection zone along the weft yarn monitor system 8. If the yarn tip 22 stops at the detector 81 in a pick, the open time of the braking device 13 can be increased for the next picks to ensure that the weft yarns are not too short on the taking side of the loom opposite the nozzle 5. Conversely, the open time of the device 13 is reduced when the yarn tip stops too near the detector 83. The control and adjustment events described are supervised by the control 4, which is connected by control lines 41, 42 and 43 to the detectors 81, 82 and 83 and is connected by a control line 46 to the magnet 131.

Figure 2:
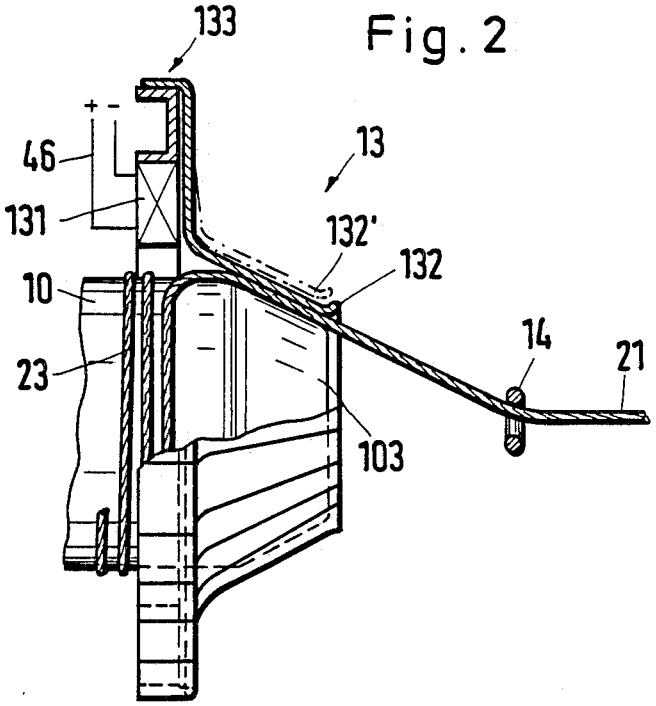
FIGS. 2 and 3 each illustrate an embodiment of braking means in accordance with the invention, the views being in side elevation and parallel to the yarn storage drum axis.

FIG. 2 is a diagrammatic view, to a larger scale than in FIG. 1, showing the construction of the braking device 13. An electro-magnet 131 is arranged in the form of a ring around the drum 10 on which the supply 23 of yarn is stored. The ring for magnet 131 carries at a place 133 a plurality of braking elements 132 which include inwardly extending portions that can pivot toward the magnet. The braking elements 132 also include end portions movable with the inwardly extending portions and being disposed in close side-by-side relationship right around the periphery of the ring.

The elements 132 are in the position 132' while the brake device 13 is open and thus leave a gap between themselves and the surface 103 of the weft yarn storage drum 10, the weft yarn 21 moving through such gap and through the eye 14 towards the main nozzle 5. When the magnet 131 is in the energized state, those parts of the elements 132 which are near it are attracted towards it to initiate braking. Because of the low-mass construction of the elements 132, there are virtually no inertia forces at the moving parts during braking, so that the braking force can be finely adjusted by means of the current flowing through the control line 46 for the electro-magnet 131. The braking force can therefore be adapted to the weft yarn to be picked.

Figure 3:
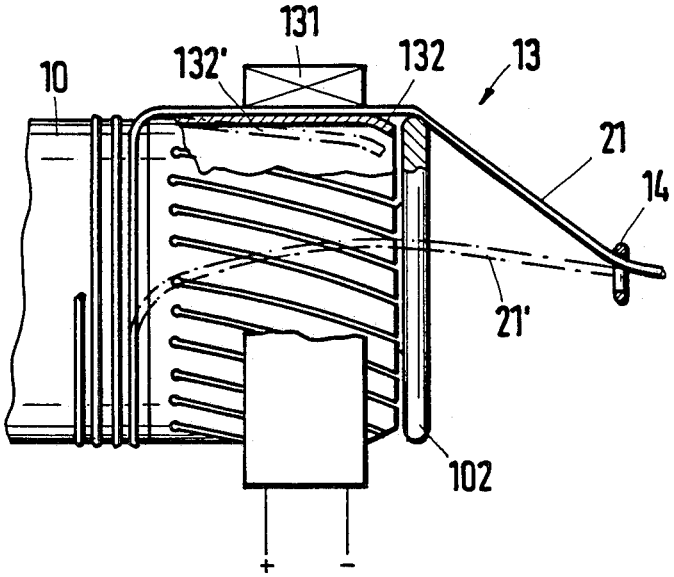

FIG. 3 shows an embodiment of the braking device 13 wherein the braking elements 132 are incorporated in the drum periphery and can be pulled towards the ring magnet 131 around them to reduce the gap through which the weft yarn passes on its way to the loom. The elements 132 are disposed at an inclination to the generatrices of the drum 10 in order that the weft yarn, which takes up a curved position, as indicated by chain lines 21', relative to the drum periphery as it is paid off, may not catch in the gaps between the elements 132. In this case the right hand termination of the drum 10 is a disc 102 around whose edge the weft yarn is deflected towards the eye 14. For braking, the braking elements change over from position 132' into position 132.

Figure 4:
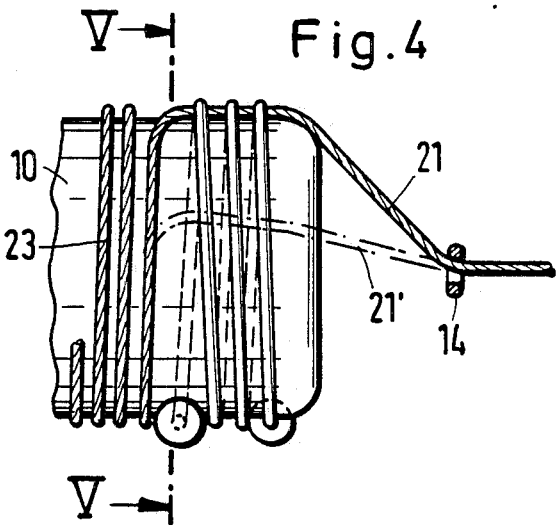
FIG. 4 is a view similar to FIGS. 2 and 3 of another embodiment of the invention.
Figure 6:
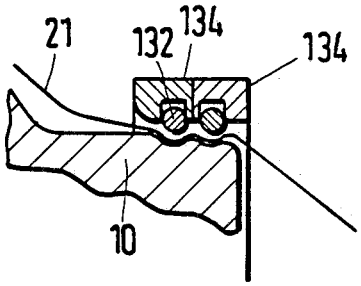
FIG. 6 is a meridian section through the drum end and the braking device with a surrounding bearing ring of the construction of FIG. 4, and FIGS. *7a* and *7b* are diagrammatic perspective views of two variants of FIG. 4.
Figure 5:
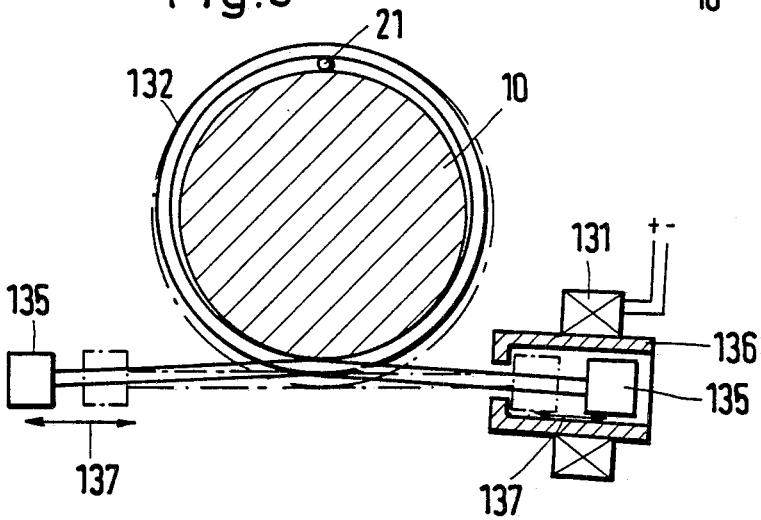
FIG. 5 is a cross-section on the line V—V of FIG. 4.
Figure 7A:
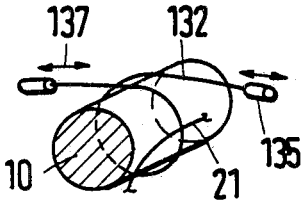
Figure 7B:
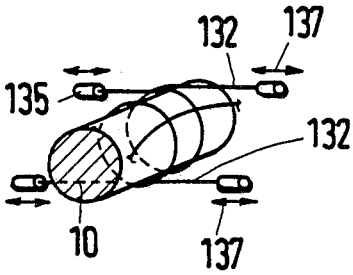

FIGS. 4 to 7 show another embodiment of a braking device according to the invention in which the braking element 132 is a wire loop. The wire can be looped around the drum periphery in a number of turns, as shown in FIG. 4. The ends of the brake element 132 can have magnet armatures 135 movable each in its own guide 136 by a magnet 131 from the chain-dotted-line position into the solid-line position in FIG. 5. When the magnetic force ceases, the armatures 135 can be drawn back into the chain-line position by the resilience of the braking element 132. The armatures 135 move parallel to the arrows 137. To ensure that the gap between the drum 10 and element 132 remains constant, guide rings 134 can be provided to guide the loop 132 radially and axially.

FIG. *7a* shows a single arrangement of a brake element 132 in the form of a resilient loop while FIG. *7b* shows a dual arrangement. The same considerations as hereinbefore set out in respect of other embodiments of the braking device apply to the operation of this embodiment so far as gentle and controllable braking is concerned.

What is claimed is:

1. A weft yarn store for looms, yarn being supplied to the store from a weft package and being drawn off from the store intermittently for picking into the shed of a loom, a drum being provided to store a weft yarn supply, a brake device being provided which comprises a rotationally symmetrical braking surface, at least one resiliently deformable low-mass brake element movable relatively to the braking surface, and means for moving the brake element relatively to the braking surface, said means for moving the brake element being an electromagnet which is in direct operative engagement with low-mass brake element parts engaging intimately with the braking surface periphery.

2. A store according to claim 1, wherein said low mass brake element parts each includes a portion projecting axially adjacent an end surface of a yarn storage drum, and wherein said axially projecting portions are disposed one beside another in surrounding relation to said drum

3. A store according to claim 1, wherein said low-mass brake element parts are resilient and in the form of a number of lamellae disposed one beside another on the outer periphery of a yarn storage drum.

4. A store according to claim 3, wherein the lamellae are incorporated in the periphery of the drum and an annular electromagnet is disposed around the drum

5. A store according to claim 1, wherein the brake element is embodied in at least one loop which extends around the periphery of a yarn storage drum, at least one end portion of the loop being connected with said electromagnet.

6. A loom comprising a weft yarn storage drum, means for winding weft yarn from a yarn source onto said drum, means for periodically drawing yarn off a discharge end of said storage drum and inserting lengths of such yarn into a weaving shed, yarn clamping means adjacent said discharge end of said storage drum actuatable periodically for engaging said yarn to prevent movement of said yarn off said drum, said yarn clamping means including low mass lamellae arranged around the axis of said drum in side by side relation to one another and each being movable in a generally radial direction to exert a clamping force on said yarn, and electromagnetic means acting directly on said lamellae for actuating said clamping means.

7. A loop comprising a weft yarn storage drum, means for winding weft yarn from a yarn source onto said drum, means for periodically drawing yarn off a discharge end of said storage drum and inserting lengths of such yarn into a weaving shed, yarn clamping means adjacent said discharge end of said storage drum and being actuatable periodically for engaging said yarn to prevent movement of said yarn off said drum, said yarn clamping means including at least one elongated low mass clamping element disposed in a loop about the periphery of said drum so that the yarn being withdrawn from said drum passes between said clamping element and the periphery of said drum, and electromagnetic means for actuating said yarn clamping means periodically by pully an end of said clamping element to tighten said loop against the periphery of said drum to clamp said yarn betwen said clamping element and said periphery.

* * * * *